US007354409B2

(12) United States Patent
Popescu

(10) Patent No.: US 7,354,409 B2
(45) Date of Patent: Apr. 8, 2008

(54) ADJUSTABLE MASSAGE SYSTEM OF SEAT TYPE

(76) Inventor: Horatiu Mircea Popescu, Knollwood Dr., Sterling Height, MI (US) 48312

( * ) Notice: Subject to any disclaimer, the term of this patent is extended or adjusted under 35 U.S.C. 154(b) by 381 days.

(21) Appl. No.: 10/969,670

(22) Filed: Oct. 21, 2004

(65) Prior Publication Data

US 2006/0089577 A1 Apr. 27, 2006

(51) Int. Cl.
*A61H 7/00* (2006.01)
*A61H 19/00* (2006.01)

(52) U.S. Cl. ..... 601/86; 601/87; 601/90; 601/93; 601/94

(58) Field of Classification Search ..... 601/23, 601/24, 26, 49, 50, 53, 56–59, 61, 62, 84–87, 601/90, 92, 93, 94, 98, 101–103, 112, 115, 601/126, 134, 148; 297/284.4
See application file for complete search history.

(56) References Cited

U.S. PATENT DOCUMENTS 4,886,051 A * 12/1989 White ..... 601/102
5,630,790 A 5/1997 Ito
5,755,677 A 5/1998 Masuda
5,792,080 A 8/1998 Ookawa
6,071,252 A 6/2000 Marcantoni
6,224,563 B1 5/2001 Nonoue et al.
6,336,907 B1 1/2002 Dono
6,387,062 B1 5/2002 Moore
6,494,849 B2 12/2002 Kuo
6,511,448 B1 1/2003 Furuie
6,616,227 B2 9/2003 Blendea
2001/0011160 A1 8/2001 Oguma
2002/0183666 A1 12/2002 Suh
2002/0193713 A1 12/2002 Lee

* cited by examiner

*Primary Examiner*—Justine R. Yu
*Assistant Examiner*—Kristen Matter

(57) ABSTRACT

An assembly comprising of spiral sub-assemblies, each provided with plastic rollers and connected to an output shaft of a gearbox attached to a swinging beam, is mounted to a seat frame with two vertical wires. Two adjustable cables are connected to the swinging beam-ends, and press the spiral assembly rollers against the seat-back cover by bending the vertical wires. The rotation of the spiral assemblies moves the contact points of the rollers with the seat-back cover up and down, creating a massage effect throughout the seat-back cover.

24 Claims, 12 Drawing Sheets

ADJUSTABLE MASSAGE SYSTEM OF SEAT TYPE

TECHNICAL FIELD

This present invention particularly relates to a massage system of seat type, and more specifically, to a mechanism providing two-directional movement with increased effective massage area and intensity adjustment device.

BACKGROUND OF THE INVENTION

Massage mechanisms for seats are typically built as flexible structures, attached to the seat frame by springs, elastic straps, or other flexible elements.

Prior inventions provide many solutions for massage seat systems.

One solution is to build a sliding frame mounted on rails and electrically actuated up and down along these rails. The moving frame is provided with rollers that press out from inside the back cover of the seat.

The solution is not particularly efficient because of the size, weight and shape complexity of the frame, which prevent the mechanism from acquiring a satisfactory stroke length. Usually, the rollers and frame move back and forth with a span no bigger than a few inches.

Another solution for massage mechanisms for seats consists of a gearbox actuating two chains or timing belts, symmetrically opposite with respect to the gearbox location. The movement of the chains directs the up and down trajectory of a roller feature, traveling along the interior of the seat back.

The solution is unsatisfactory because of the complexity of the entire construction, as well as the weight, high cost and short stroke mechanism.

SUMMARY OF THE INVENTION

Consequently, a simpler, cheaper, and lighter solution is desirable, with fewer components, such as a pair of pivoting spirals, equipped with plastic rollers, whose rotation induces movable contact points with the back of the seat, from the inside out. It is also desirable to provide a solution with adjustable pressure contacts.

Massage mechanisms are typically challenging systems to design because they are required to fit a limited space inside the seat, have adjustable pressure contact with the seat back, generate a long stroke to cover the entire length of the seat back, produce less noise and free play, and are also required to be cost competitive.

The present invention, as defined by the claims, provides a lighter construction assembly with fewer components. It also provides actuators to adjust the contact pressure between the spirals and the inside surface of the seat back. The actuators transfer their adjusting movements through flexible cables, such as Bowden cables.

A further aspect of the invention provides synchronized actuators for symmetrical spiral mechanisms, which create the massage effect of the seat.

The present invention provides multiple rollers mounted on flexible spiral wires to reduce the torque motion and to prevent the ware of the inside surface of the seat back in contact with the massage elements.

Another aspect of the invention provides insulation contact elements between rollers, in order to reduce noise and avoid rattling.

All the abovementioned features of the present invention, in relation to other concepts, advantages, and technical solutions, are easily apparent from the study of the invention's description, claims, and related drawings, where they are extensively explained.

DETAILED DESCRIPTION OF THE PREFERRED EMBODIMENT

Figure 1:
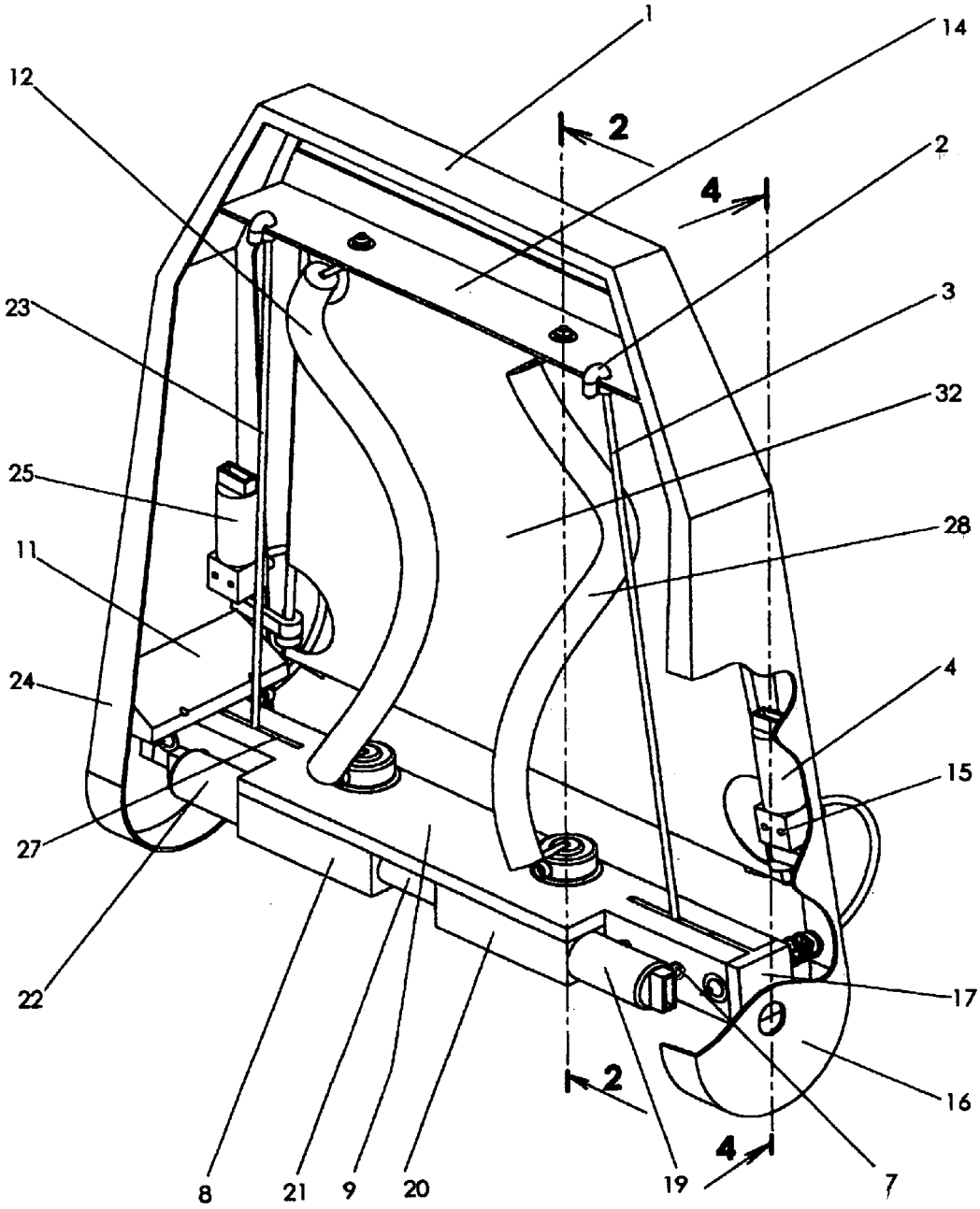
FIG. 1 shows an isometric assembly view of the spiral massage devices assembled into the seat frame.

Referring to the drawings, FIG. 1 illustrates the massage system assembled into the seat in a functional position.

The massaging action is applied on a backrest cover 32 from the inside out by rotating the spiral assemblies 12 and 28 at constant speed. Each spiral assembly has at least one contact point with the inside of the backrest cover. Through rotation, the contact point M, visible in FIG. 8, indents the cover of the seat back, and the bulge created travels downward, executing the massage.

The system consists of an adjustable beam 9, suspended from a fixed horizontal beam 14—part of the seat frame, by two hanging vertical wires 3 and 23.

On the lower side, the vertical wires 3 and 23 are secured into the vertical side slots 27 of the adjustable beam 9, and held in place by compressing the sides of the slots 27 with two pairs of bolts 7. Each bolt is mounted through a clearance hole on one side of the slots 27, and a threaded hole on the other side.

The bolts 7 flank each of the verticle wires 3 and 23. By tightening the bolts 7, the lower part of the wires is compressed and held in position without rattling or movement, suspending beam 9 from the fixed beam 14, and allowing the adjustable beam 9 to swing.

Both lower end portions of the wires 3 and 23 are provided with a 90°-angle bend in order to prevent the suspended beam 9 from sliding downward while system is functioning.

Both upper end portions of wires 3 and 23 are bent in the shape of a hook, and hang from the fixed beam 14 through two holes provided. To avoid rattling, the hook portions of wires 3 and 23 are wrapped in rubber sleeves 2.

Figure 4:
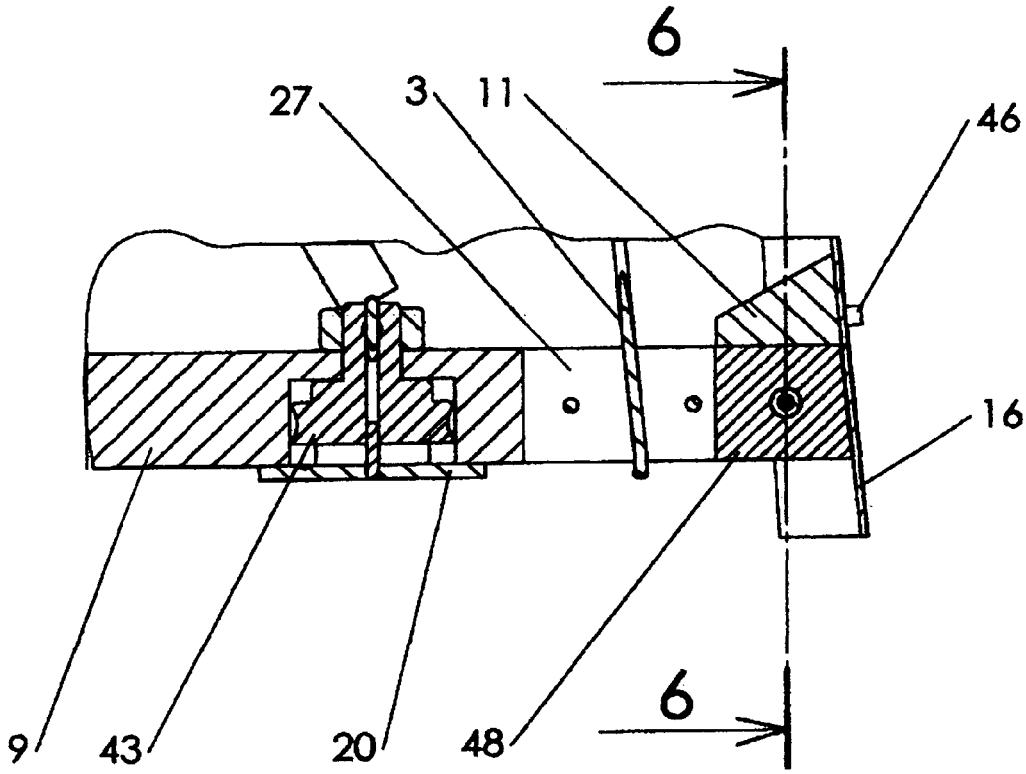
FIG. 4 shows the lower right side area of median section 4-4 of the seat through pivoting axis of the spiral devices.

The swinging of the beam 9 is guided at each end by a nylon guide 11, mounted above beam 9 on both sides 16 and 24 of the vertical frame 1 with the bolts 46, visible in section 4-4 FIG. 4.

When the beam 9 swings, the nylon guides 11 allow it to slide beneath them, and prevent its rising during the functioning and disengagement of the suspending wires 3 and 23 from the hook area of horizontal beam 14.

The nylon guides 11 also prevent the bending of wires 3 and 23, keeping them stretched during the massage process.

The two nylon spacers 17, mounted one on each end of the lower beam 9, restrain its side-to-side movement.

The flat side-portion of each nylon spacer 17 is mounted between the beam 9 and the adjacent sides 16 and 24 of the vertical frame 1. The tabs 48 of the nylon spacers 17, visible in FIG. 4 and FIG. 6, protrude into the side slots 27 of the lower swinging beam 9, and are kept in place by the formed tubings 47, visible in FIG. 6.

Figure 2A:
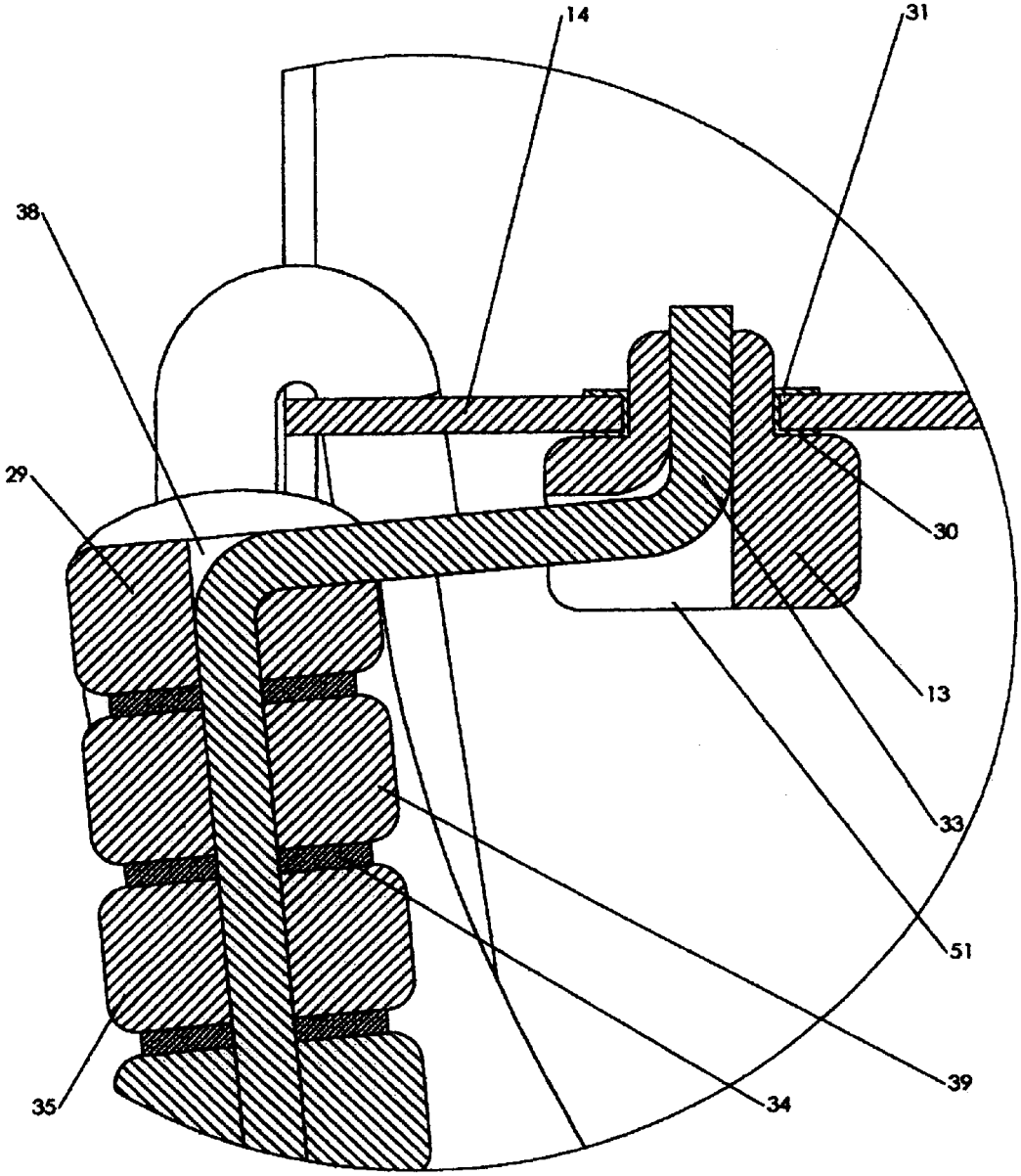
FIG. 2*a* shows the upper bearing area of the vertical transversal section 2-2 of the seat through the pivoting axis of a spiral device.

In FIG. 2*a*, the upper bearing section 2-2 is presented.

The spiral wire 33 of each spiral assembly 12 and 28 is mounted through a nylon bushing 13. The upper end of the wire 33 extends through the hole of the bushing 13, while inside the nylon it bends though a groove 51 cut into the lower end of the bushing 13.

The nylon bushing 13 is mounted on horizontal beam 14 through a Norton bushing 31, from the bottom up.

Due to the Teflon coating of the Norton bushing 31, when the spiral wire 33 rotates, the groove 51 spins the bushing 13 on the Norton bushing surface 30, and prevents relative motion of nylon on steel, extending the life of the bearing.

The upper bearing section of the spiral assembly 28 also shows the nylon bushing 29 as the upper end of the nylon rollers 35 and felt disks 34, mounted alternatively with the rollers 35 on the spiral wire 33. The bushing 29 is provided with a groove 38 to prevent relative movement between the nylon component 29 and the steel spiral wire 33. During the rotation of the spiral assembly 28, roller 39 touches the seat-back cover 32 and spins. Due to this rotation, roller 39 rubs the bent arm of wire 33. The role of the nylon bushing 29 is to prevent the nylon-steel relative movement, expanding the life of the assembly.

The felt disks 34 have the role of preventing rattling and decreasing the friction between the rollers 35, and between the roller 39 and the nylon bushing 29.

Figure 2B:
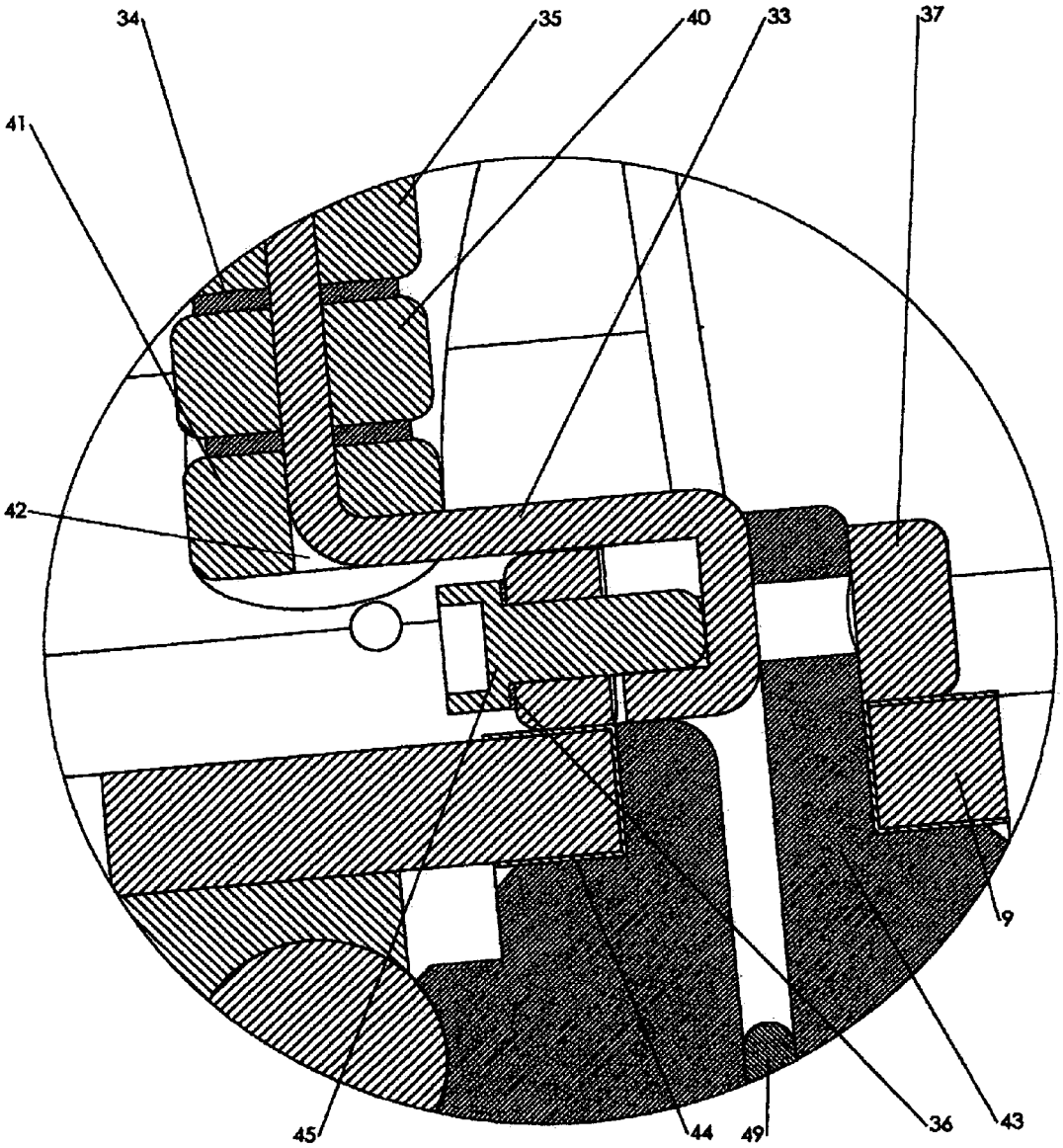
FIG. 2*b* shows lower bearing area of the vertical transversal section 2-2 of the seat through the pivoting axis of a spiral device.

In FIG. 2*b*, the lower bearing section is presented.

The nylon bushing 41 represents the lower end of the nylon rollers 35 and felt disks 34, mounted alternatively on the spiral wire 33. When in contact with the seat back cover 32, the roller 40 spins, generating a relative movement with respect to the nylon bushing 41. The bushing 41 is provided with a groove 42 to prevent relative movement between the nylon component 41 and the steel spiral wire 33.

During the rotation of the spiral assembly, the rollers 35 and 40 touch the seat-back cover 32, spin, and lean against component 41, preventing the last roller 40 to rub against the bent arm of wire 33.

The role of the nylon bushing 41 is to prevent the nylon-steel relative movement. The felt disks 34 have the role of preventing rattling and decreasing the friction between the rollers 35, and between the roller 40 and the nylon bushing 41.

Figure 5:
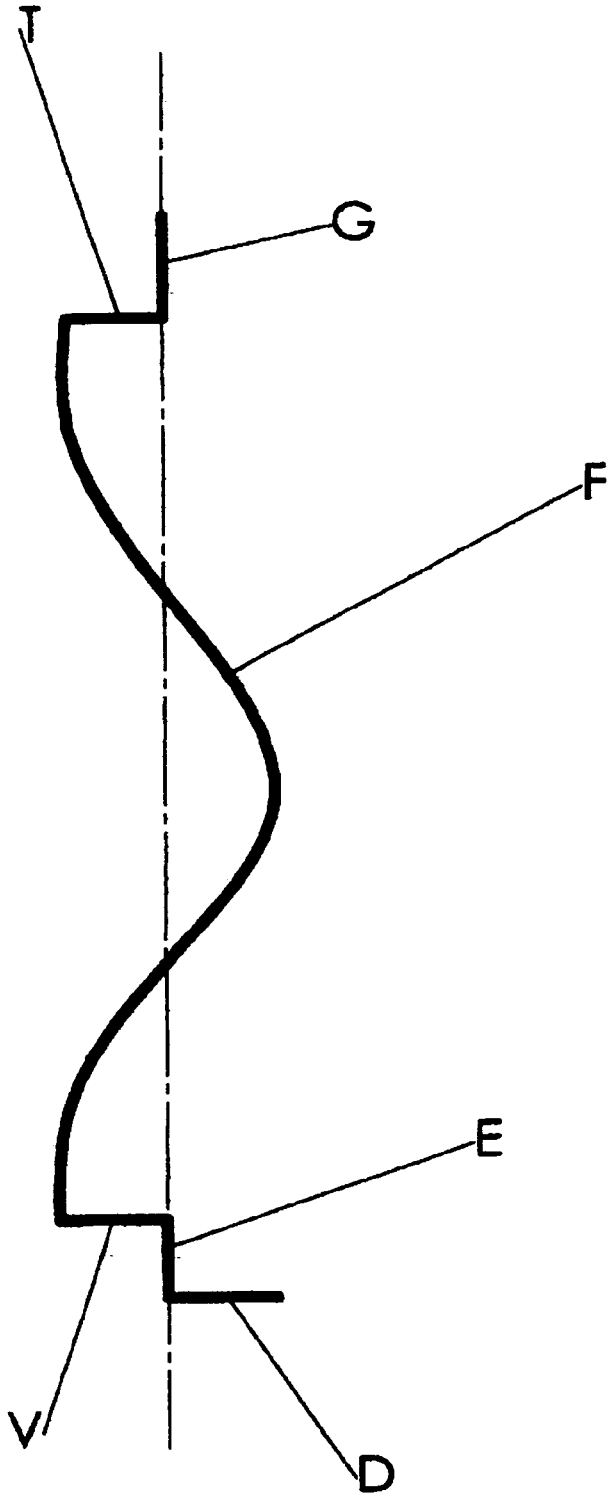
FIG. 5 shows regions of the spiral wire within the spiral device.

The spiral wire 33 is connected to the worm gear 43, which in turn is part of the gearbox 20 for the spiral assembly 28. The crank D of the spiral wire 33, depicted in FIG. 5, is mounted at the very bottom of a groove 50, visible in FIG. 3, cut into the hub of the worm gear 43, which is the output shaft for the gearboxes 8 and 20, visible in FIG. 1.

Figure 3:
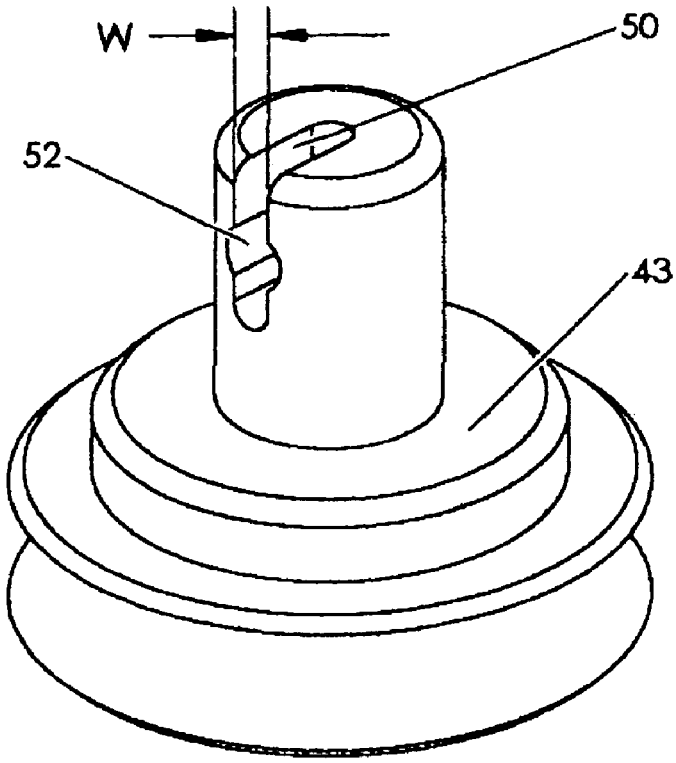
FIG. 3 shows the particular construction of the worm gear component of the spiral gearboxes.

Continuing with the presentation of FIG. 2*b* and FIG. 3, the worm gear 43 is mounted through the beam 9—using a Norton bushing 44, and pivots on the pin 49—mounted in each housing of the gearboxes 8 and 20. On the opposite side of the beam 9, a steel ring 37 is mounted on the hub of the gearbox 43. The ring 37 is provided with one threaded hole for a screw 45. The outside diameter of the screw 45 is larger than the width W of the groove 50, cut into the hub of the worm gear 43, illustrated in FIG. 3.

The groove 50 has one transversal notch 52 on each side, visible in FIG. 3, provided through the middle of the hub of gear 43, to accommodate the mounting of the screw 45 used to compress the pivoting area E of the spiral wire 33 until it reaches the axis of the worm gear 43.

Once mounted through the washer 36 and tightened—see FIG. 2*b*, the screw 45 prevents the worm gear 43 from coming out of the wall of beam 9—due to contact of the ring 37 with the Norton bushing 44. It also prevents the spiral wire 33 from being pulled out of the hub of the gearbox 43—due to the transversal notches 52 of the groove 50, and ensures the identity of the axis of the worm gear 43 and the pivoting axis of the spiral wire 33.

The solution provided for the connection between the spiral wire 33 and the worm gear 43 smoothes the movement due to the permanent contact of the Teflon coated surface of the Norton bushing 44 with the steel ring 37 on one side, and with the same type of coated bushing surface on the other side, at the shoulder of the worm gear 43.

Figure 7:
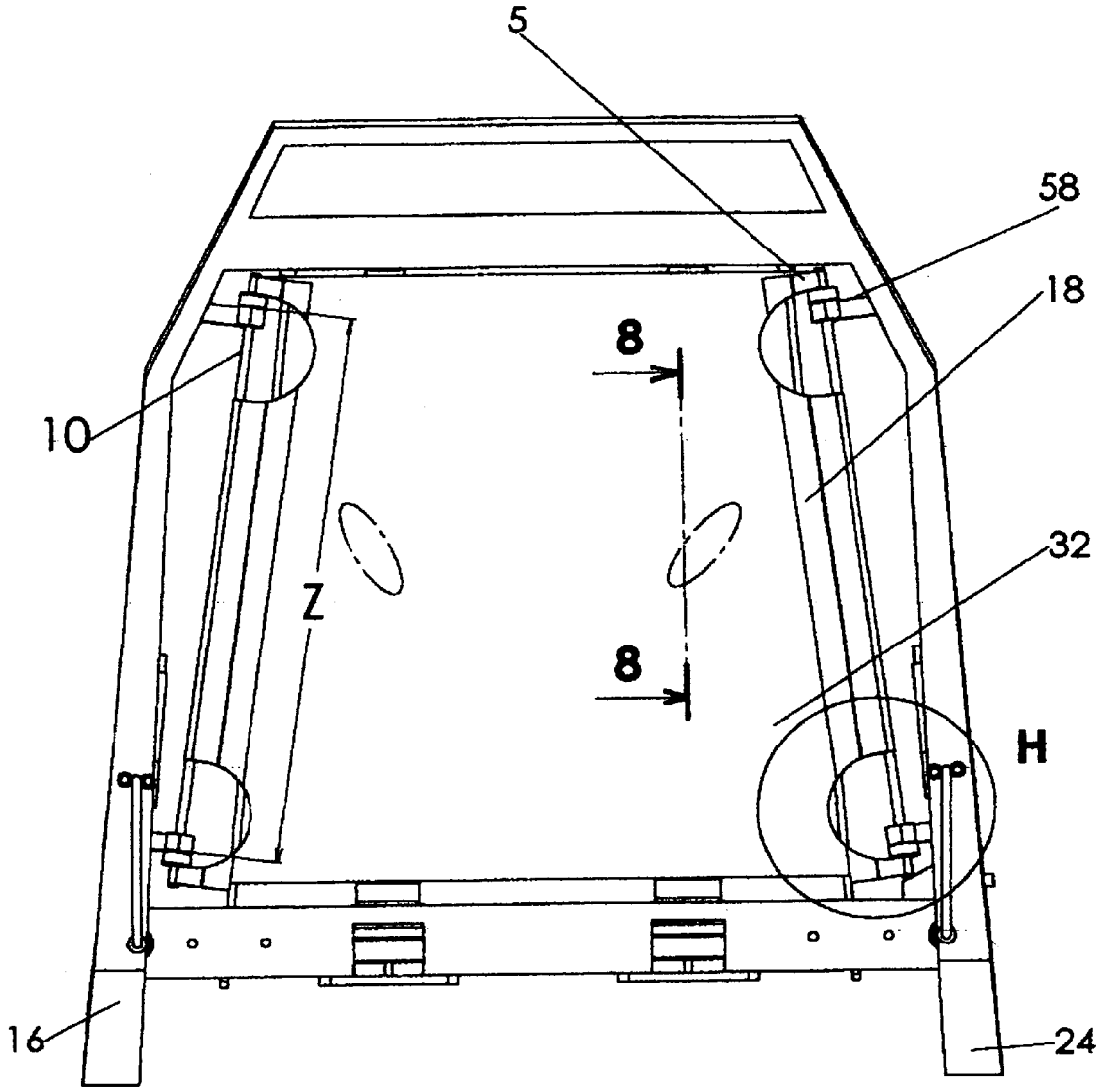
FIG. 7 shows a front view of the passenger side seat-back cover assembly.

The worm gear 43, as an output component of the gearboxes 8 or 20, transfers the movement from the electrical motors 19 or 22, visible in FIG. 1, through the gearboxes 8 or 20 to the spiral assemblies 12 or 28, generating the massage effect on the seat-back cover 32, visible in FIG. 1 and FIG. 7.

In order to have a synchronized movement of the spiral systems, the gearboxes 8 and 20 are mechanically connected to each other through a shaft 21, visible in FIG. 1.

Figure 6:
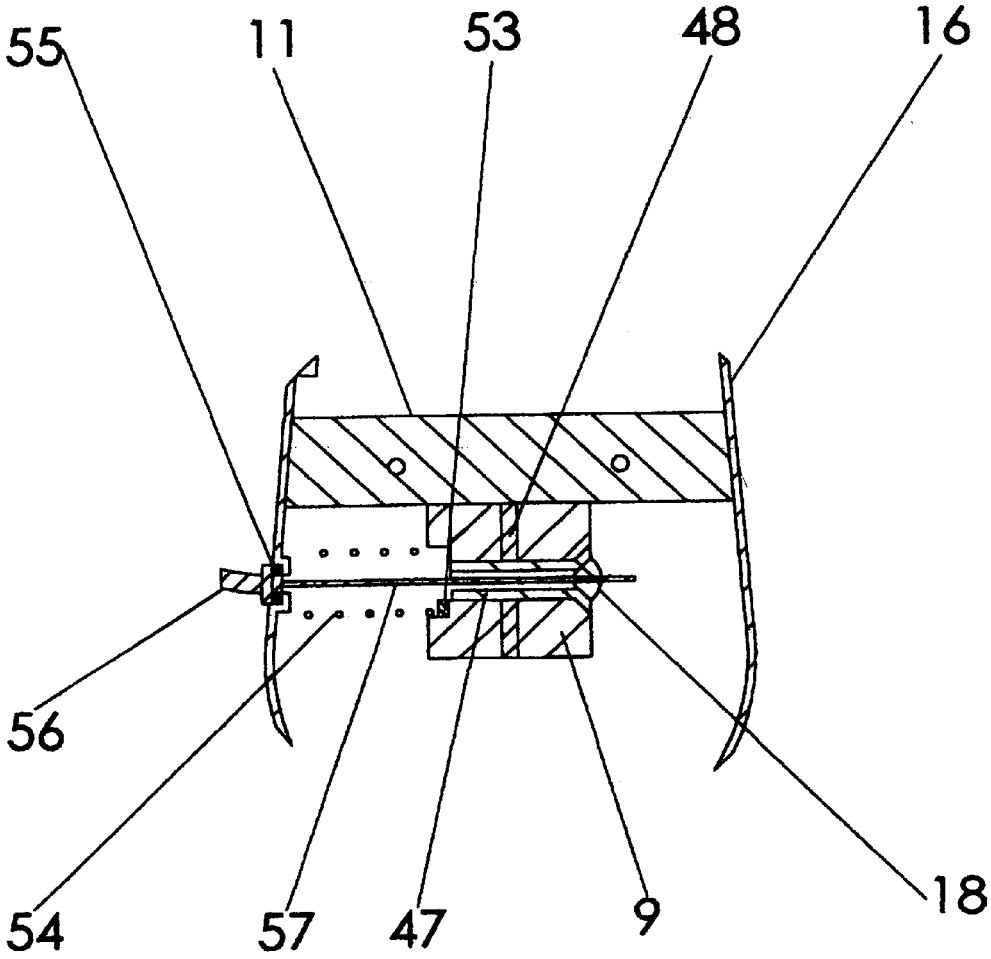
FIG. 6 shows a vertical transversal section 6-6 through the axis of the seat's adjustable right side cable.

Continuing with the description of FIG. 6 and FIG. 5, the construction to adjust the pressure of the massage system is described.

The low-pressure position of the massage system is ensured by the springs 54, visible in FIG. 6, placed one on each side of beam 9. The springs push the beam away from the seat cover 32, and have an opposite effect to that of the Bowden cables 56—the latter also being mounted one on each side of beam 9.

To increase the pressure of the massage system on the back cover 32 of the seat, cables 57 are pulled toward the seat-back cover 32 via the gearboxes provided with electrical motors 4 and 25—mounted on the frame 1 with the bolts 15, and the conduits of Bowden assemblies 56—see FIG. 1. The cable ends 18, visible in FIG. 6, crimped on the cables 57, press the tubings 47 in contact with the beam 9, underneath the nylon guides 11, and toward the seat-back cover 32, compressing the springs 54 and increasing the massage pressure. The relaxation of the system caused by the springs 54 is possible only when the cables 57 of the Bowden cable assemblies are released from the gearboxes 4 and 25, by controlling the current intensity and polarity of the electrical motors of these gearboxes.

The anchor point of the Bowden cables 56 is the washers 55, mounted one on side 16 and one on side 24 of the seat frame.

The springs 54 are mounted between the seat frame sides 16 and 24, and lean on the flat washers 53, mounted one at each end of the beam 9 into a locating counter bore provided—see FIG. 6.

In FIG. 5, the structure of the spiral wires is detailed.

The wires 33 have two straight pivoting areas, E and G, which constitute the axis of rotation of the spiral assemblies 12 and 28. Area F of the wires 33 is the spiral itself, on which the nylon rollers 35 and the felt disks 34 are mounted along with the end nylon bushings 29 and 41. This F area is connected to the pivoting areas G and E by two arms T and V respectively. The length of these connecting arms also influences the massage pressure of the system. The lower pivoting area E ends in a 90°-angle bend, materializing the area D, the crank of the spiral wire 33.

Figure 8:
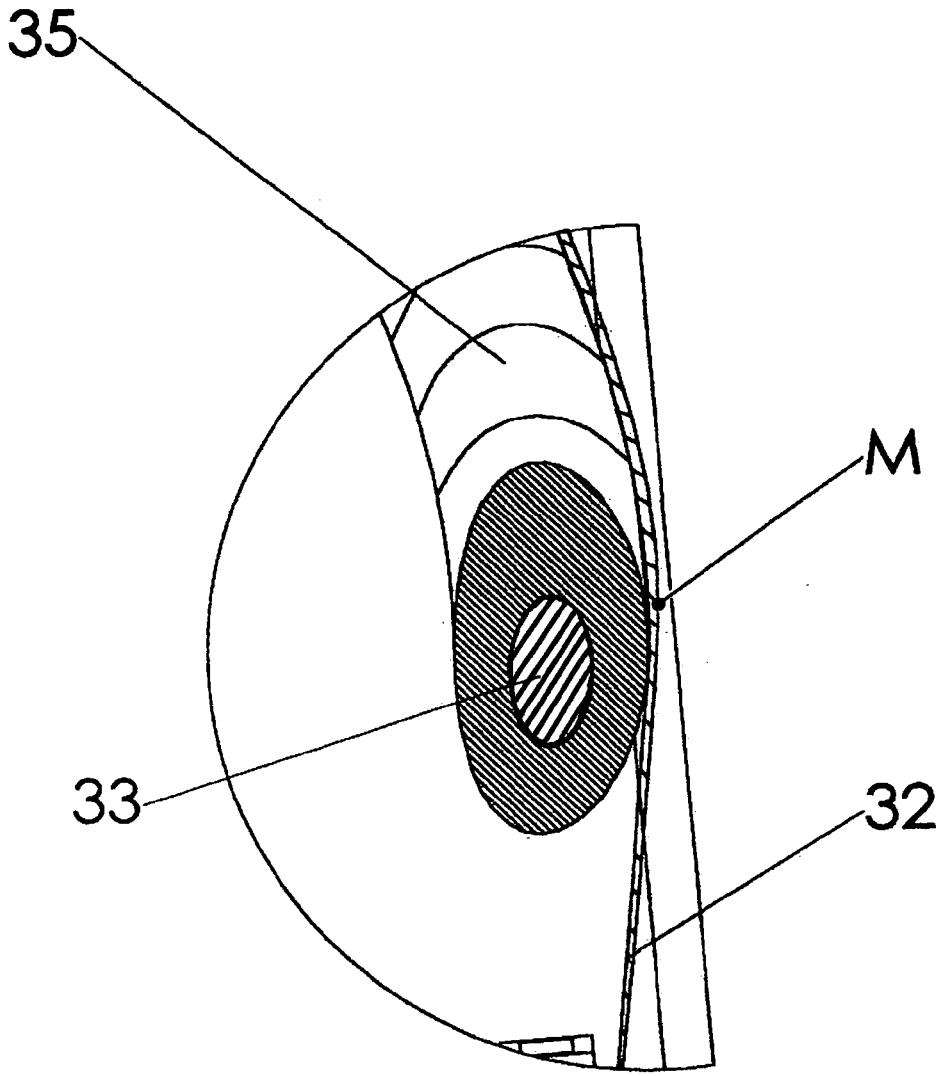
FIG. 8 shows a section through the active area of the spiral assembly feature and the protrusion through the seat back cover.
Figure 9:
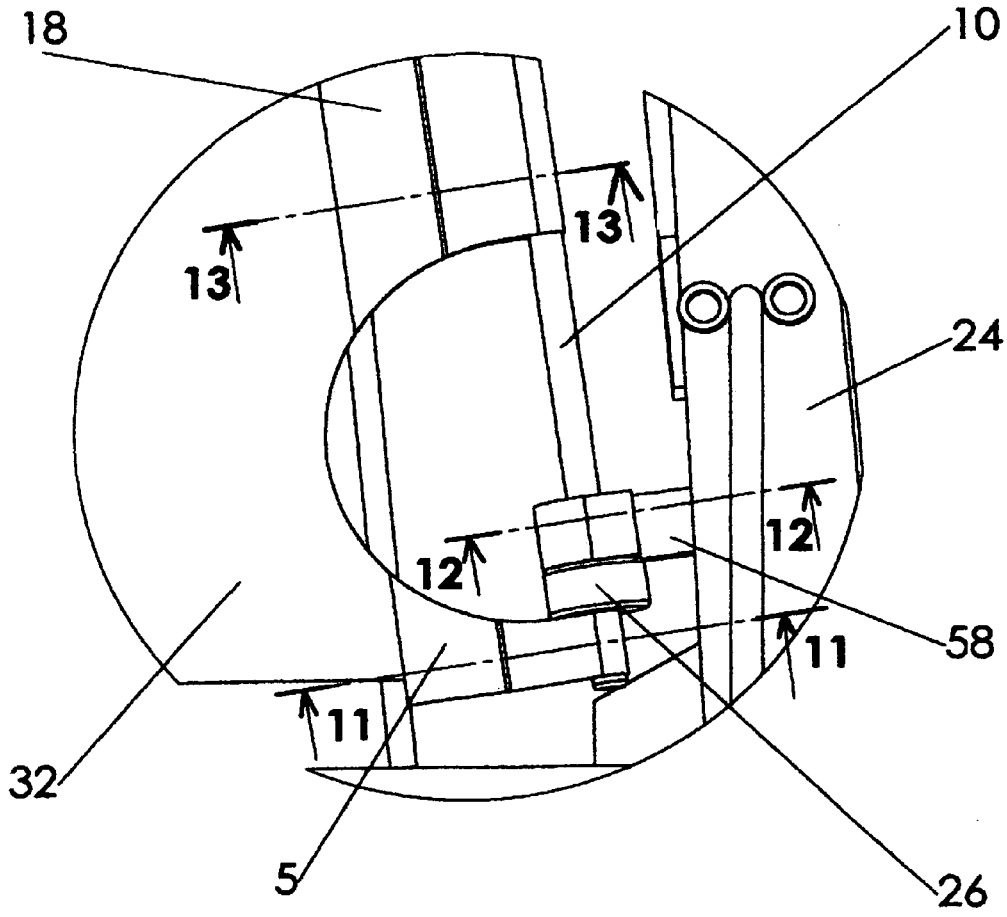
FIG. 9 shows a detail of the backrest cover assembly, mounted on the seat frame.

In FIG. 7, FIG. 8 and FIG. 9, the mounting solution of the seat back cover 32 is revealed.

Figure 11:
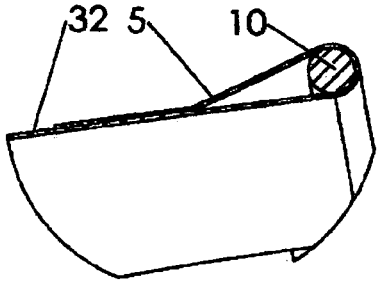
FIG. 11 shows the detail section 11-11 of the backrest cover mounted on the cover assembly wire.

In FIG. 7, each side of the seat frame 16 and 24 has the welded hooks 58 attached. The seat-back cover 32 is provided with six wings, three on each side. The two center wings 18 are wrapped inward and sewn to create a loop for the cover assembly wires 10. A cross-section 13-13 of this area, which position is visible in FIG. 9, is provided in FIG. 13. The remaining four corner wings 5, visible in FIG. 7, are wrapped inward and sewn to create narrower loops for the ends of the cover assembly wires 10. A detailed section 11-11 of this area, which position is visible in FIG. 9, is provided in FIG. 11.

The cover assembly wires 10 are flexible, easily taking the shape of the seat's load. The detail H in FIG. 7 is represented in FIG. 9, and indicates the position of the hooks 58 and the loops of the seat-back cover 32 with respect to the cover assembly wire 10. FIG. 9 also indicates the position of the sections 13-13, 12-12 and 11-11.

In FIG. 8, a section 8-8 through the active area of the spiral assembly 12 is illustrated. The location of section 8-8 is indicated in FIG. 7.

In this section 8-8, the rollers 35 are pushed against the back cover 32, generating a bulge area, materializing the contact point M, the active massage point of each of the spiral assemblies 12 and 28.

Figure 10:
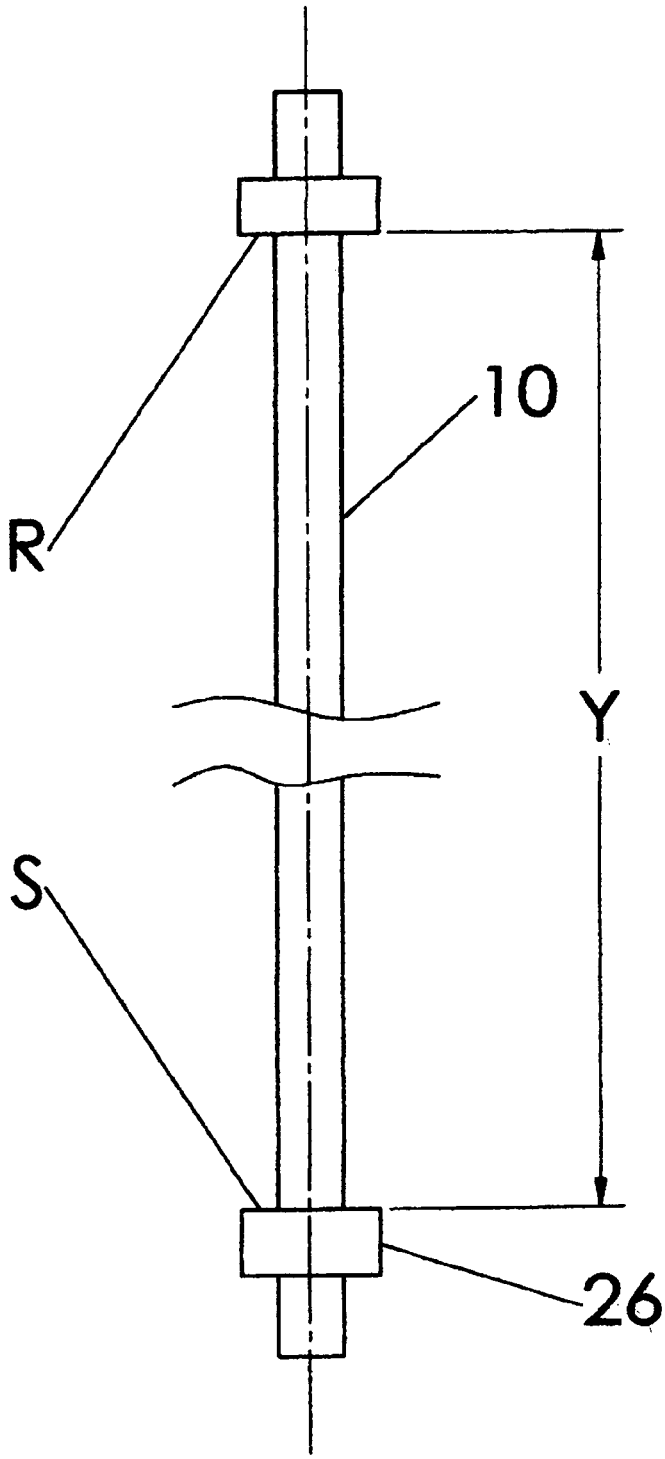
FIG. 10 shows the cover assembly wire.

FIG. 10 depicts the shape and features of the cover assembly wire 10. Each wire is provided at both its ends with a stop washer 26, with the distance between the two washers, Y, being identical to the outside distance Z between the mounting hooks 58—see also FIG. 7 and FIG. 9.

Figure 12:
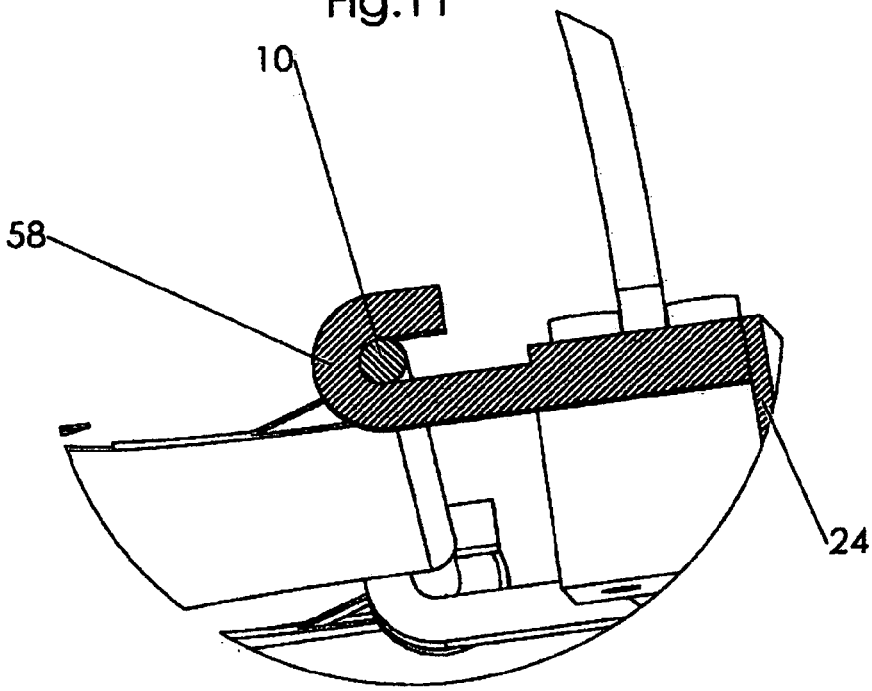
FIG. 12 shows the detail section 12-12 of the backrest cover assembly wire, mounted on the seat frame.

Mounting the cover assembly wires 10 with the side surfaces R and S—visible in FIG. 10, touching the outside surface of the hooks 58, will prevent the rattling and the movement of the seat cover relative to the seat frame. The rod of the cover assembly wire 10 hangs from the hooks 58 attached to the seat frame, as shown in section 12-12, depicted in FIG. 12.

Figure 13:
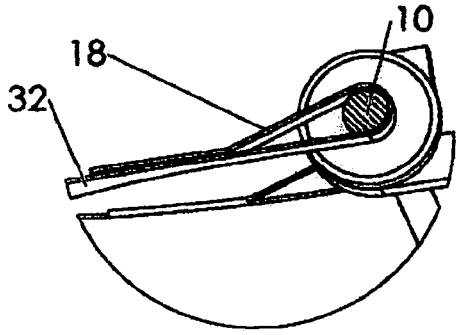
FIG. 13 shows the detail section 13-13 of the backrest cover mounted on the cover assembly wire.

In FIG. 13, in which section 13-13 is illustrated, the cover assembly wire 10 is holding the loop 18 of the back cover 32 in place under the pressure of the spiral assemblies 12 and 28.

While the most detailed description of the invention has been presented, those specialized within the art, to which this invention pertains, will recognize alternative designs and embodiments within the scope of the invention's claims.

The invention claimed is:

1. A massage system for a seat having a seat frame with sides the massage system comprising:

a swinging beam articulated to the seat frame by at least one vertical wire;

at least two spiral assemblies mounted for rotation in the seat frame;

two plastic guides mounted on the seat frame sides, above and in contact with said swinging beam;

two plastic spacers mounted on said swinging beam and in contact with the seat frame sides;

a pressure-adjusting feature attached to the seat frame and connected to said swinging beam, the pressure adjusting feature including flexible cable assemblies and springs;

at least one actuator attached to said swinging beam and having an output shaft for driving said spiral assemblies; and a seat-back cover attached to the seat frame.

2. The massage system according to claim 1 wherein the spiral assemblies each comprise:

a spiral or helix wire;

a set of rollers;

a set of anti-vibration and anti-rattling disks between adjacent rollers;

an upper-end bushing; and a lower-end bushing.

3. The massage system according to claim 2 wherein each spiral or helix wire comprises:

at least one spiral or helix area to mount the rollers and anti-vibration and anti-rattling disks;

at least one crank area to transfer the movement from the output shaft of the actuator to the spiral assembly;

at least one straight pivoting area to create the pivoting axes of the spiral assemblies; and at least one connecting arm between the pivoting area and the spiral or helix area.

4. The massage system according to claim 1 wherein the at least one vertical wire is swinging from the seat frame.

5. The massage system according to claim 1 wherein the rotation of the spiral assemblies is synchronized to generate a symmetrical movement.

6. The massage system according to claim 1 wherein said spiral assembly is connected to the output shaft by a ring provided with a screw and wherein the screw is mounted though the ring into a groove of the output shaft of the actuator and is vertically secured by notches on either side of the groove.

7. The massage system according to claim 1 wherein each spiral assembly has at least one movable contact point with the seat back, and generates an up and down massage motion by rotation of the spiral assemblies assembly.

8. The massage system according to claim 1 wherein the seat back cover may be made of canvas, felt, plastic, composite or any other flexible material.

9. The massage system according to claim 1 wherein the seat-back cover may be provided with sewn, riveted, staked or weaved loops to facilitate its attachment to the seat frame.

10. The massage system according to claim 1 wherein the seat-back cover may be attached to the seat frame by at least one cover assembly wire.

11. The massage system according to claim 1 wherein said spiral assembly comprises:

at least one molded helix shaped component; and, at least one flexible or rigid element forming a spiral or helix support for the component.

12. The massage system according to claim 1 wherein said pressure adjusting feature comprises:

at least two springs in front of the swinging beam and at least one flexible cable in front of the swinging beam, whereby the flexible cable and the springs adjust the position of the swinging beam relative to the seat frame.

13. The massage system according to claim 1 wherein the rotation of the spiral assemblies is not synchronized, and the spiral assemblies generate asymmetrical movement.

14. The massage system according to claim 1 wherein the swinging beam may comprise a stamping, a solid bar, a welded subassembly or a molded part, and may be made of plastic, metal or composite material.

15. The massage system according to claim 1 wherein the pressure adjusting feature for each said spiral assembly provides variable displacement for a contact point with the back cover.

16. A massage system for a seat having a frame and a seat-back cover on the frame, the massage system comprising:

a first beam that is fixed in position relative to the frame;

a second beam that is movably mounted relative to the frame;

at least one spiral assembly having a first end and a second end, wherein said first end is mounted to the first beam and said second end is mounted to the second beam, and an actuator for rotating the at least one spiral assembly, whereby the rotation of the spiral assembly generates a moving point of contact between the spiral assembly and the seat back cover and a massage effect on the seat back cover.

17. The massage system for the seat of claim 16 further comprising a mechanism for suspending the second beam for swinging motion relative to the frame, whereby the second beam is movable toward and away from the seat back cover as a result of the swinging motion.

18. The massage system of claim 17 wherein the mechanism for suspending the second beam for swinging motion is a pair of wires suspending the second beam from the first beam.

19. The massage system of claim 16 further comprising:

a pressure adjustment mechanism for the massage system, the pressure adjusting mechanism adjusting the position of the second beam relative to the seat back cover to adjust the pressure of the at least one spiral assembly on the seat back cover.

20. The massage system of claim 19 further comprising:

at least one spring and one flexible cable comprising the pressure adjustment mechanism, wherein the spring and flexible cable are used to adjust the position of the second beam relative to the seat back cover.

21. The massage system according to claim 16 wherein the spiral assembly comprises a helix wire and a set of rollers mounted on the wire.

22. The massage system according to claim 21 further comprising anti-vibration and anti-rattling disks mounted on the helix wire and alternating with the rollers.

23. The massage system of claim 16 further comprising:

two spiral assemblies mounted parallel to one another between the first and second beams, wherein the rotation of the two spiral assemblies is synchronized so that the massage effect on the seat back cover is synchronized.

24. The massage system of claim 16 further comprising:

two spiral assemblies mounted parallel to one another between the first and second beams, wherein the rotation of the two spiral assemblies is not synchronized so that the massage effect on the seat back cover is asymmetrical.

* * * * *